US007299516B2

(12) United States Patent
Nuetzel et al.

(10) Patent No.: US 7,299,516 B2
(45) Date of Patent: Nov. 27, 2007

(54) CONSTRUCTION OF A CORROSION-RESISTANT TENSION MEMBER IN THE AREA OF A REROUTING POINT ARRANGED ON A SUPPORT, PARTICULARLY AN INCLINED CABLE ON THE PYLON OF A CABLE STAYED BRIDGE

(75) Inventors: Oswald Nuetzel, Munich (DE); Egbert Zimmermann, Haar (DE)

(73) Assignee: Dywidag-Systems International GmbH, Aschheim (DE)

( * ) Notice: Subject to any disclaimer, the term of this patent is extended or adjusted under 35 U.S.C. 154(b) by 130 days.

(21) Appl. No.: 11/141,021

(22) Filed: Jun. 1, 2005

(65) Prior Publication Data

US 2005/0262648 A1 Dec. 1, 2005

(30) Foreign Application Priority Data

Jun. 1, 2004 (DE) ..... 20 2004 008 620 U

(51) Int. Cl.
*E01D 11/04* (2006.01)
*E01D 19/14* (2006.01)
*E04C 5/08* (2006.01)

(52) U.S. Cl. ..... 14/22; 52/223.1; 52/223.14

(58) Field of Classification Search ..... 14/18, 14/21, 22; 52/223.1, 223.14
See application file for complete search history.

(56) References Cited

U.S. PATENT DOCUMENTS 6,476,326 B1 * 11/2002 Fuzier et al. ..... 174/95
6,880,193 B2 * 4/2005 Figg et al. ..... 14/21

FOREIGN PATENT DOCUMENTS

DE 88 10 423.0 U1 12/1988

* cited by examiner

*Primary Examiner*—Raymond Addie
(74) *Attorney, Agent, or Firm*—McGrath, Geissler, Olds & Richardson, PLLC

(57) ABSTRACT

A corrosion-resistant tension member, particularly an inclined cable of a cable stayed bridge, is comprised of a bundle of individual elements, for example, steel wire strands, which in the open area is encapsulated by sheathing, and which in the area of a rerouting point, for example, at the pylon of a cable-stayed bridge, extends inside a saddle pipe in a canal having the shape of a circular arc. In order to avoid impairments at the ends of the saddle pipe when sheathing is connected to the structure, the saddle pipe is extended in the shape of a circular arc beyond a tangential exit of the bundle by a length L so that the bundle is exposed at an end of the saddle pipe without any risk of abutting.

20 Claims, 2 Drawing Sheets

CONSTRUCTION OF A CORROSION-RESISTANT TENSION MEMBER IN THE AREA OF A REROUTING POINT ARRANGED ON A SUPPORT, PARTICULARLY AN INCLINED CABLE ON THE PYLON OF A CABLE STAYED BRIDGE

This nonprovisional application claims priority under 35 U.S.C. § 119(a) on Patent Application No. DE 20 2004 008 620.4 filed in Germany on Jun. 1, 2004, which is herein incorporated by reference.

BACKGROUND OF THE INVENTION

1. Field of the Invention

The invention is directed to the construction of a corrosion-resistant tension member in the area of a rerouting point that is arranged on a support, particularly an inclined cable on the pylon of a cable-stayed bridge.

2. Description of the Background Art

It is known with cable stayed bridges to load-transmittingly connect the inclined cables with the pylon, with the inclined cables extending at an angle to one another and with which the roadway pillar is stayed against the pylon and which are primarily comprised of a bundle of individual elements, for example, steel wire strands. This for one can be accomplished with the stays coming from different directions all converging to the pylon to be anchored there, at times in a crisscross fashion; this requires a plurality of anchoring devices. Another option is to run the stays over the pylon in a saddle-like fashion, whereby the load-bearing forces extending at a right angle to the stay cable axis are transferred via the saddle to the pylon.

If such an inclined cable is damaged, for example, by the presence of corrosion on the steel tension members, there must be the possibility to replace such an inclined cable. In a conventional solution, a saddle-shaped canal is formed in the pylon for this purpose, into each of which one inclined cable can be inserted (DE 88 10 423 U). The lower area of the canal is comprised of a half tube forming a support trough with a saddle bearing at the vertex, where a saddle pipe sheathing the bundle of individual tension members in this area can be locked into place to avoid longitudinal offset. This is done with a bearing sleeve that is arranged in the vertex of the reversing point along the support trough, which is fitted with a bearing ring that is attached to the saddle pipe.

For stabilization purposes and to bond the individual tension members of the bundle with the saddle pipe, the remaining interstices are filled with a hardening material, for example, cement mortar. To improve the adhesion to the hardening material, the tension members, that is, for example, the steel wire strands, can preferably be roughened by sandblasting, at least in the area of the vertex.

In the conventional solution, the saddle pipe is directly connected with the sheathing of the bundle in the open area of the inclined cable outside the pylon by flange rings. As a result, the canal formed in the pylon must have a relatively large diameter or at least a greater height than the diameter of the bundle, to make it possible to replace the bundle with the saddle pipe, and is open on the front entry and/or exit point of the inclined cable. This opening is a disadvantage, because it is exposed to environmental influences and accessible to animals, particularly birds, which can cause dirt buildups and corrosion.

SUMMARY OF THE INVENTION

It is therefore an object of the present invention to provide a simple and economical method, which also foremost takes statical requirements into consideration, to close the openings in the guide canal for the inclined cable of a cable stayed bridge.

To provide a solution, the invention is based on the idea to close off the openings on the front side of the guide canal such that the sheathing in the open area of the inclined cable is directly or indirectly connected to the structure, namely the pylon. To stay the inclined cable against longitudinal movements in the area of the saddle, the saddle pipe, which transmits such forces by adhesion, cannot be dispensed with. Therefore, care must be taken so that the individual tension members at their exit from the rigid saddle pipe are not damaged or otherwise interfered with, even with unavoidable installation tolerances, temperature shifts, or pipe oscillations.

The teaching of the invention to extend the saddle pipe in the shape of a circular arc beyond the tangential exit of the bundle such that the bundle is exposed at the end of the saddle pipe without any risk of abutting, is a very simple alternative to ensure that the bundle of strands is raised at the end of the saddle pipe, even with installation tolerances, without any risk of abutting or even a bend. Thus, an elaborate trumpet-shaped expansion of the end of the saddle pipe is no longer necessary, thereby making it possible for the recess pipe, which forms the saddle-shaped guide canal for the inclined cable in the pylon, to be smaller in diameter than the saddle pipe end that is expanded at the exit point of the bundle, when exchangeability is required.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is described in more detail therebelow with reference to an embodiment illustrated in the drawing, wherein.

DETAILED DESCRIPTION

Figure 1:
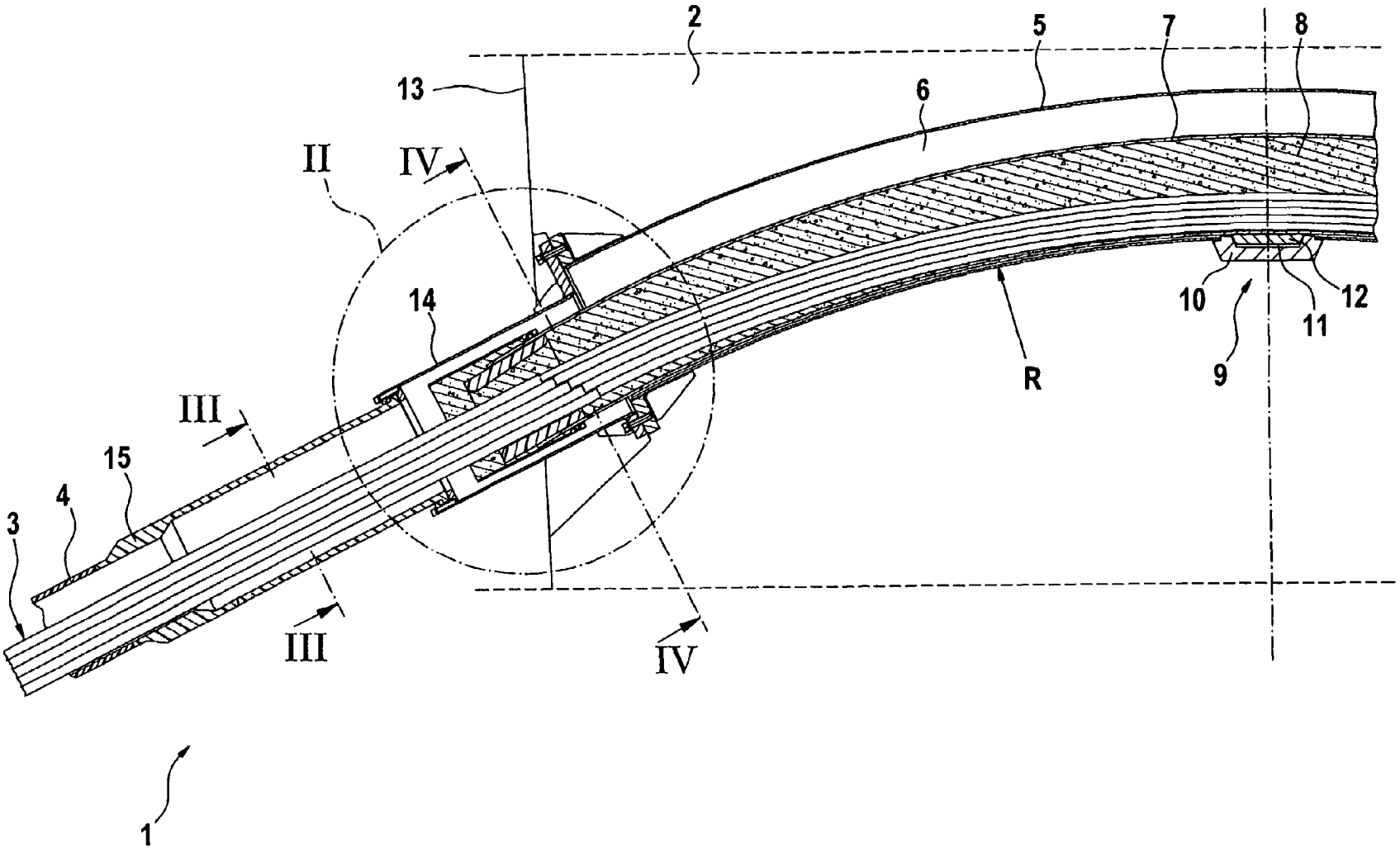
FIG. 1 is a vertical cross section through a rerouting point of a rerouted inclined cable that is run in a saddle shape over a pylon.

FIG. 1 illustrates an embodiment of the invention in a vertical cross section, showing an inclined cable 1 that is rerouted on a pylon 2 made of steel-reinforced concrete. The inclined cable 1 is comprised of a bundle 3 of individual tension members, for example, steel wires, steel rods, or steel strands, which in their open area are arranged inside a sheathing 4, for example, a pipe sheath made of PE (polyethylene).

In the pylon 2, a saddle-shaped canal 6 having an oval cross section, an open front side, and a radius R, into which the inclined cable 1 can be inserted from the outside in, is formed through a recess pipe 5. In the area of its passage through the pylon 2, the bundle 3 itself, is also guided in a steel saddle pipe 7 in the shape of a circular arc, inside of which the individual tension members of the bundle 3 are bonded with the saddle pipe 7 by grouting mortar 8.

In the vertex area 9 of the rerouting point, a recessed saddle bearing 10 with a recess 11 is located, with which a cleat 12 that is firmly attached to the saddle pipe 7 by welding, for example, engages. This type of anchoring, while allowing complete exchangeability of the stay cable 1, reliably ensures the prevention of longitudinal movements during the installation of the inclined cable and at the same time allows the absorption of differential forces that occur in the longitudinal direction of the inclined cable 1. During the replacement process, this construction allows for the entire inclined cable 1 to be lifted with the saddle pipe 7 until the cleat 12 disengages from the recess 11; the oval shape of the recess pipe 5 leaves enough upper space to do this. Thereafter, the inclined cable 1 with the saddle pipe 7 along the circular bend of the rerouting area per radius R can be pulled from the canal 6.

Figure 2:
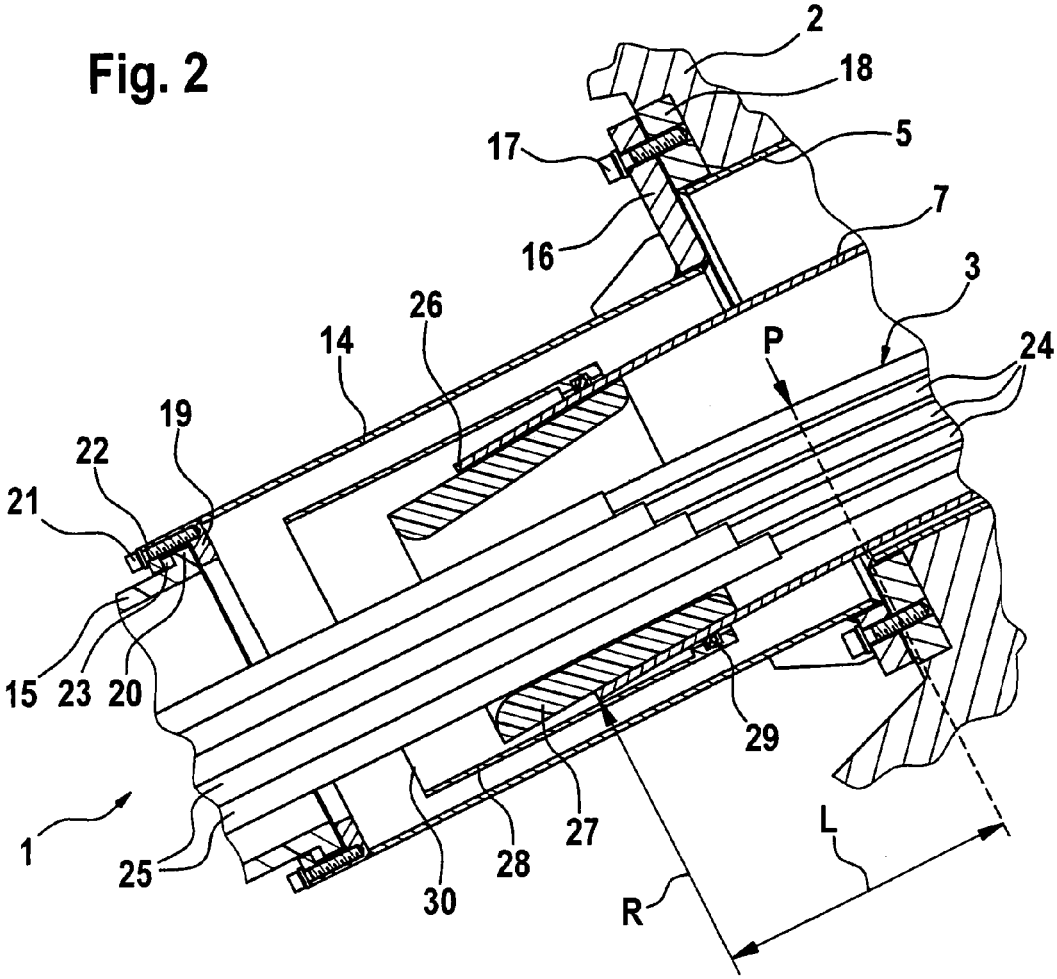
FIG. 2 shows the detail II in FIG. 1 at a larger scale.
Figure 3:
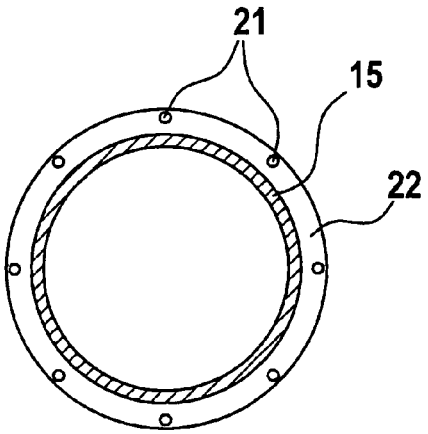
FIG. 3 is a cross section through a sheathing of the inclined cable along the line III-III.
Figure 4:
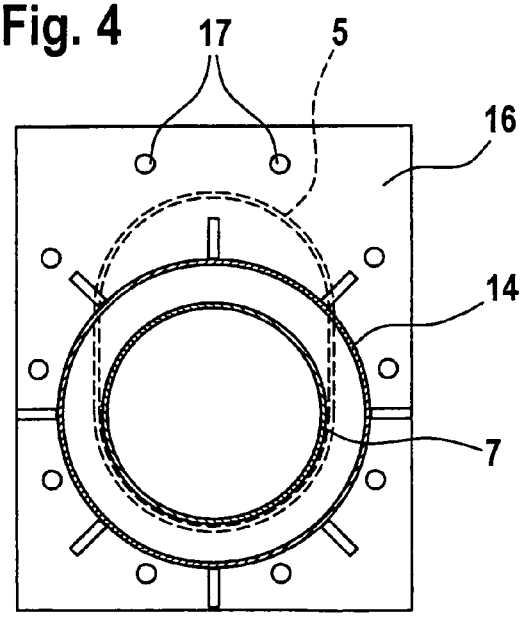
FIG. 4 is a cross section through the sheathing along the line IV-IV in FIG. 1.

The connection of the sheathing 4 of the inclined cable 1 to the structure, namely the pylon 2, and the behavior of the saddle pipe 7 in this area can be seen in FIGS. 2 to 4.

As is shown in FIG. 1, a steel connecting pipe 14 is arranged between the sheathing 4 and the outer wall 13 of the pylon 2, which is detachably connected to the sheathing 4 on the one hand and to the pylon 2 on the other hand. In order to handle diameter differences better, a transition pipe 15 can be arranged between the sheathing 4 in the normal area and the connecting pipe 14, which, like the sheathing 4, can be made of plastic, particularly PE.

As can be particularly seen in FIG. 2, which is an enlarged illustration of the detail II in FIG. 1, the connecting pipe 14 at the end facing the structure has a flange plate 16, which can be of a rectangular shape (FIG. 4). The flange plate 16 can be detachably connected to the structure 2 by a screw connection 17, for example, opposite an anchor plate 18 that is set in concrete. The flange plate 16 also takes the transition from the oval cross section of the recess pipe 5 to the circular cross section of the inclined cable 1 into consideration, illustrated herein with the cross section of the connecting pipe 14 and that of the saddle pipe 7.

To construct a detachable connection between the connecting pipe 14 and the sheathing 4, in this illustration a transition pipe 15, the connecting pipe 14 has an inner flange 19 on the sheathing end, against which an outer flange 20 of the transition pipe 15 abuts from the outside. The friction-locked connection between the transition pipe 15 and the connecting pipe 14 is ensured by an axis-parallel screw connection 21, which acts against a loose flange ring 22. Due to the flange ring 22 that is attachable from the outside, the installation of the sheathing is substantially simplified. The force of the screw connection bears on the welded-on PE flange 20 via a ring 23 that is made of an elastic material, for example, rubber or plastic; in this way, constraint tensions due to potentially occurring angle errors are avoided. Furthermore, a softer load transmission from pipe oscillations onto the screw connection 21 is thereby achieved.

FIG. 2 also shows the construction of the saddle pipe 7 of this invention in the area of the exit of the inclined cable 1 from the pylon 2. It can be seen how the individual elements of the bundle, which in the area of the saddle pipe 7 are bare, that is, not sheathed, but in the open area of the inclined cable 1 are individually encapsulated for corrosion protection, for example, strands 24 with PE sheathings 25, make the tangential transition from the circular direction with the radius R within the saddle pipe 7 to the straight direction in the open area of the inclined cable 1. This transition can be roughly localized at the exit of the inclined cable 1 from the pylon 2 in the area of line IV-IV in FIG. 1; it is referenced in FIG. 2 by the arrow P. According to the invention, the length L of the saddle pipe 7 with its circular arc along the radius R is extended beyond this point P to ensure that the end 26 of the saddle pipe 7 is sufficiently spaced apart from the bundle 3 in a radial direction, particularly in its lower area.

In order to achieve a constant soft redirecting of the bundle 3 in this area, particularly with lateral angle deviations, which can be easily determined on site, a cushioning element 27 that is made of an elastic and/or ductile material can be arranged at the at the inner wall of the end of the saddle pipe 7. In its most simple form, this cushioning element 27 can be a piece of pipe; however, it can also be a molded part having an inner contour with rounded edges that is adapted to the behavior of the bundle 3, as illustrated in FIG. 2. It is beneficial to extend this cushioning element 27 beyond the end 26 of the saddle pipe 7 so as to always ensure a soft support for the bundle 3 there.

In order to be able to fill this entire area of the saddle pipe 7 with grouting mortar 8, too, a formwork pipe 28 is temporarily put over the end of the saddle pipe 7, which is sealed off against the saddle pipe 7 by a seal 29. After the front opening 30 of the formwork pipe 28 is sealed off, the entire cavity can be grouted, as is illustrated in FIG. 1. An illustration of the grouting was omitted in FIG. 2 for reasons of clarity. In order to avoid cracking of the mortar during movement, it is recommended to add wire mesh or the like as reinforcement at the front end.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A saddle pipe for a cable stayed bridge, the saddle pipe extending arcuately within a recess pipe that is provided in a pylon of the cable stayed bridge, the saddle pipe extending beyond the recess pipe such that a space is formed between a lower end edge of the saddle pipe and a bundle of cables which extend through the saddle pipe.

2. A stay support system, comprising:

a tension member, wherein the tension member comprises a bundle of individual tension elements, wherein the bundle includes an open area comprising a sheathing encapsulating the individual tension elements;

a structural support comprising a canal having a circular arc shape, wherein the canal defines a rerouting point for the tension member; and a saddle pipe having a circular arc shape and an enclosure, wherein the saddle pipe extends within the canal, the tension member extends through the saddle pipe, and the saddle pipe extends beyond a tangential exit of the bundle from the structural support by a length L, such that the bundle is exposed at an exit area of the saddle pipe without abutting the enclosure of the saddle pipe.

3. The system according to claim 2, further comprising a cushioning element made of a plastic and/or a ductile material arranged in the exit area of the bundle from the saddle pipe.

4. The system according to claim 3, wherein the cushioning element has a circular shape.

5. The system according to claim 3, wherein an inner contour of the cushioning element substantially contours the bundle.

6. The system according to claim 2, wherein the tension member comprises an inclined cable and the structural support comprises a pylon of a cable stayed bridge.

7. The system according to claim 2, wherein the individual elements are steel wire strands.

8. The system according to claim 3, wherein the cushioning element comprises polyethylene.

9. The system according to claim 2, wherein the individual elements comprise wires, rods, or strands.

10. The system according to claim 2, wherein the canal comprises an ovular shaped pipe which defines a rerouting cavity for the saddle pipe and bundle.

11. The system according to claim 2, further comprising a saddle bearing defining a recess.

12. The system according to claim 11, further comprising a cleat attached to the saddle pipe, wherein the cleat operatively engages the saddle bearing to control longitudinal movement of the tension member.

13. The system according to claim 2, wherein the structural support is a pylon of a bridge.

14. The system according to claim 13, further comprising a connecting pipe detachably connected with an outer wall of the pylon and the sheathing of the bundle.

15. The system according to claim 14, wherein the connecting pipe comprises an inner flange and a flange plate, wherein the flange plate is operatively connected to the outer wall of the pylon.

16. The system according to claim 15, further comprising:

a transition pipe having an outer flange, wherein the transition pipe is operatively connected to the inner flange of the connecting pipe and to the sheathing.

17. The system according to claim 16, further comprising a cushioning element arranged in the exit area of the bundle in a position between the bundle and an end of the saddle pipe.

18. A method of securing a stay support system, the method comprising:

providing the stay support system that comprises:

a tension member, wherein the tension member comprises a bundle of individual tension elements, and wherein the bundle includes an open area comprising a sheathing encapsulating the individual tension elements, a structural support comprising a canal having a circular arc shape, wherein the canal defines a rerouting point for the tension member, and a saddle pipe having a circular arc shape and an enclosure, the saddle pipe extending within the canal, the tension member extending through the saddle pipe, and the saddle pipe extending beyond a tangential exit of the bundle from the structural support by a length L, such that the bundle is exposed at an exit area of the saddle pipe without abutting the enclosure of the saddle pipe; and anchoring the saddle pipe within a saddle bearing of the canal.

19. The method according to claim 18, wherein anchoring comprises engaging a cleat attached to the saddle pipe within a recess of the saddle bearing.

20. The method according to claim 18, further comprising:

positioning a form over an end of the saddle pipe; and grouting the rerouting cavity.

* * * * *